US010307636B1

(12) United States Patent
Brown

(10) Patent No.: US 10,307,636 B1
(45) Date of Patent: Jun. 4, 2019

(54) NECK AND SHOULDER EXERCISE DEVICE

(71) Applicant: Earnest Brown, Tampa, FL (US)

(72) Inventor: Earnest Brown, Tampa, FL (US)

( * ) Notice: Subject to any disclaimer, the term of this patent is extended or adjusted under 35 U.S.C. 154(b) by 30 days.

(21) Appl. No.: 15/641,377

(22) Filed: Jul. 5, 2017

(51) Int. Cl.
*A63B 23/025* (2006.01)
*A63B 21/06* (2006.01)
*A63B 21/00* (2006.01)

(52) U.S. Cl.
CPC ..... *A63B 23/025* (2013.01); *A63B 21/06* (2013.01); *A63B 21/151* (2013.01); *A63B 21/4003* (2015.10)

(58) Field of Classification Search
CPC ... A63B 23/025; A63B 5/16; A63B 21/00181; A63B 21/0442; A63B 21/4009; A63B 21/0552; A63B 21/068; A63B 21/154; A63B 21/0085; A63B 21/00047; A63B 23/1218; A63B 2210/50; A63B 7/00
See application file for complete search history.

(56) References Cited

U.S. PATENT DOCUMENTS 559,270 A * 4/1896 Edwards ..... A63B 21/0552 482/10
1,517,147 A * 11/1924 Burnett ..... A63B 23/025 482/10
1,543,346 A * 6/1925 Titus ..... A63B 23/025 482/10
4,645,198 A 2/1987 Levenston
5,105,803 A * 4/1992 Burton ..... A61H 1/0218 482/143
5,242,347 A 9/1993 Keeton
D363,547 S * 10/1995 Huber ..... D24/191
6,036,625 A 3/2000 Woodruff
6,106,437 A 8/2000 Brooks
6,939,269 B2 * 9/2005 Makofsky ..... A63B 21/154 482/10
8,840,528 B2 9/2014 Zylstra
9,233,275 B2 * 1/2016 Gatherer ..... A63B 24/0006

FOREIGN PATENT DOCUMENTS

CA 2419347 A1 6/2004

* cited by examiner

*Primary Examiner* — Megan Anderson

(57) ABSTRACT

The neck and shoulder exercise device is a harness worn on the head of a person. The neck and shoulder exercise device attaches to a commercially available weight machine commonly used for strength. By attaching the weights associated with the weight machine to the neck and shoulder exercise device the person can use the weight machine to train the muscles supporting the head of the person. The neck and shoulder exercise device comprises a plurality of straps, a plurality of seams, a plurality of hooks, and a fastener. The plurality of seams: 1) interconnects the plurality of straps to each other; and, 2) attaches the plurality of hooks to the plurality of straps. The fastener secures the neck and shoulder exercise device to the head of the person. The plurality of hooks are used to attach the neck and shoulder exercise device to the weight machine.

12 Claims, 4 Drawing Sheets

NECK AND SHOULDER EXERCISE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of health and amusement including apparatus for physical training, more specifically, an interface for attaching the head of a body to exercise apparatus for developing and strengthening muscles of the body.

SUMMARY OF INVENTION

The neck and shoulder exercise device is a harness. The neck and shoulder exercise device is adapted for use with a person. The person is further defined with a head. The neck and shoulder exercise device is worn on the head of the person. The neck and shoulder exercise device attaches to a commercially available weight machine commonly used for strength. By attaching the weights associated with the weight machine to the neck and shoulder exercise device the person can use the weight machine to train the muscles supporting the head of the person. The neck and shoulder exercise device comprises a plurality of straps, a plurality of seams, a plurality of hooks, and a fastener. The plurality of seams: 1) interconnects the plurality of straps to each other; and, 2) attaches the plurality of hooks to the plurality of straps. The fastener secures the neck and shoulder exercise device to the head of the person. The plurality of hooks are used to attach the neck and shoulder exercise device to the weight machine.

These together with additional objects, features and advantages of the neck and shoulder exercise device will be readily apparent to those of ordinary skill in the art upon reading the following detailed description of the presently preferred, but nonetheless illustrative, embodiments when taken in conjunction with the accompanying drawings.

In this respect, before explaining the current embodiments of the neck and shoulder exercise device in detail, it is to be understood that the neck and shoulder exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the neck and shoulder exercise device.

It is therefore important that the claims be regarded as including such equivalent construction insofar as they do not depart from the spirit and scope of the neck and shoulder exercise device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
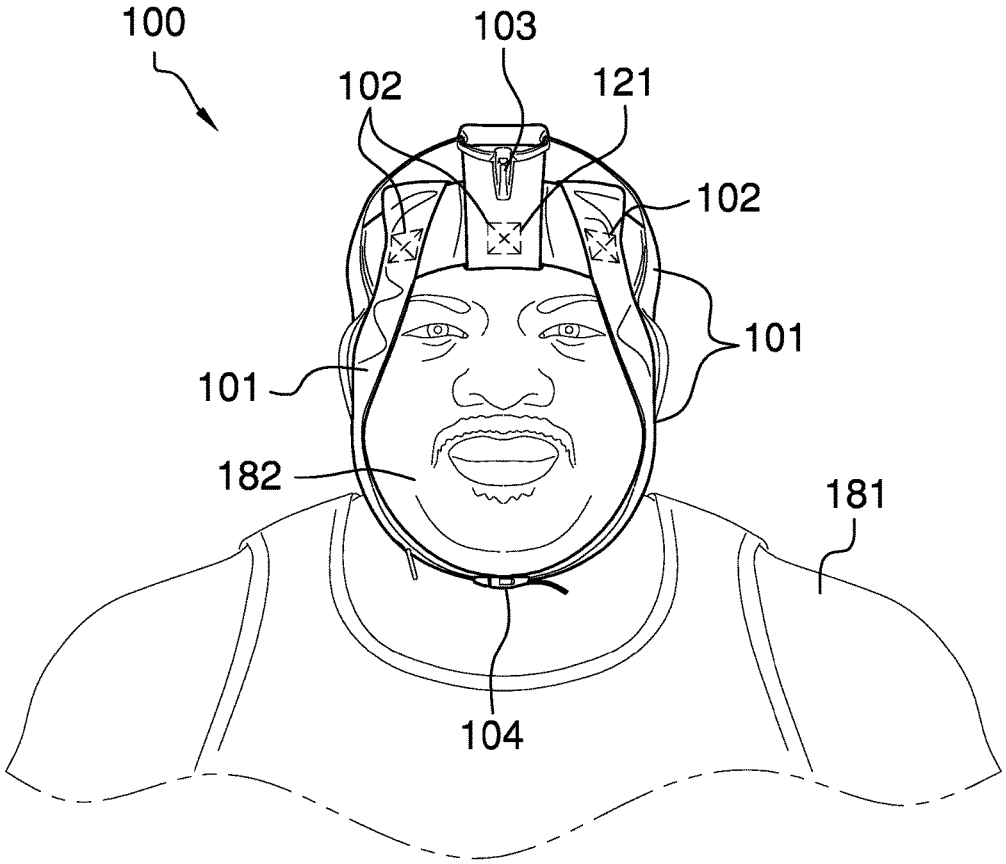
FIG. 1 is a front view of an embodiment of the disclosure.
Figure 2:
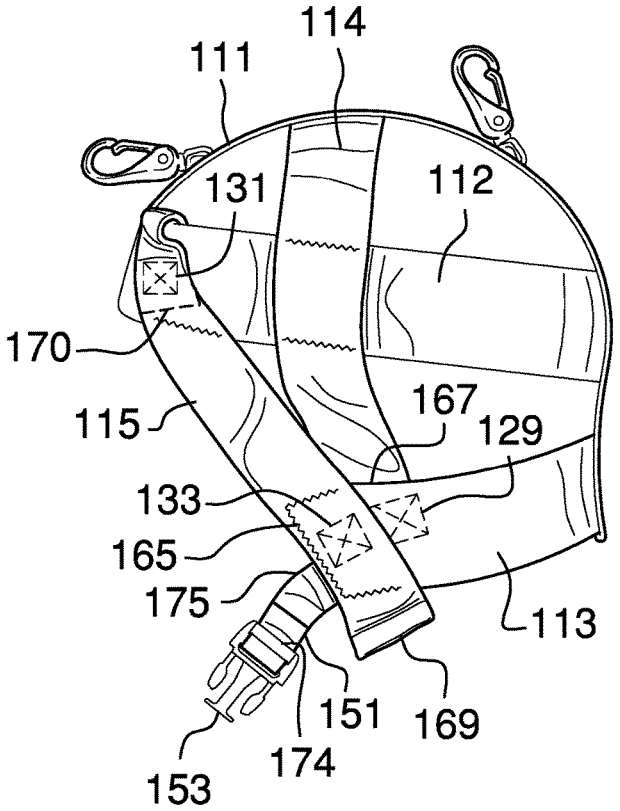
FIG. 2 is a side view of an embodiment of the disclosure.
Figure 3:
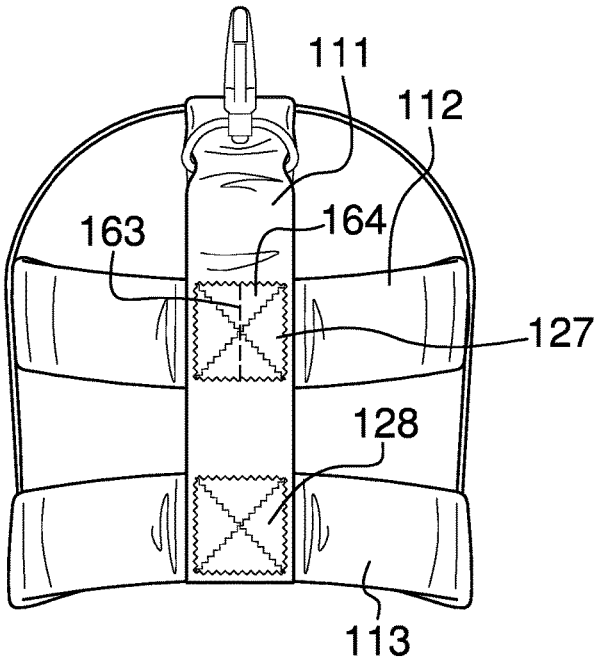
FIG. 3 is a rear view of an embodiment of the disclosure.
Figure 4:
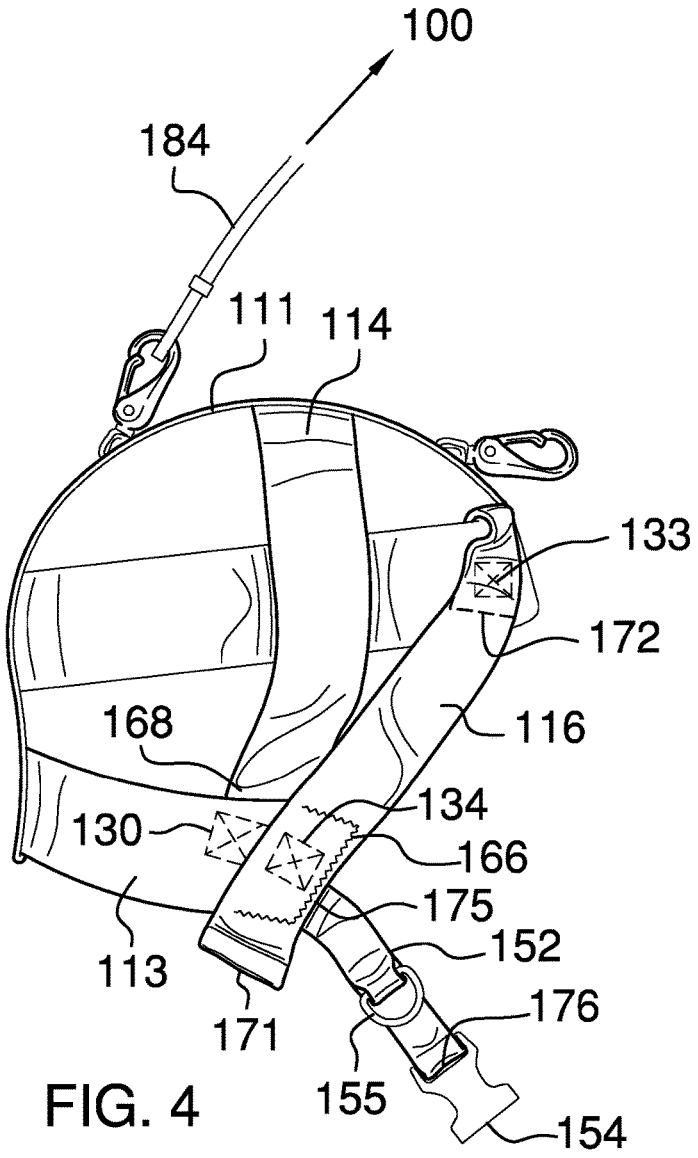
FIG. 4 is an opposite side view of an embodiment of the disclosure.
Figure 5:
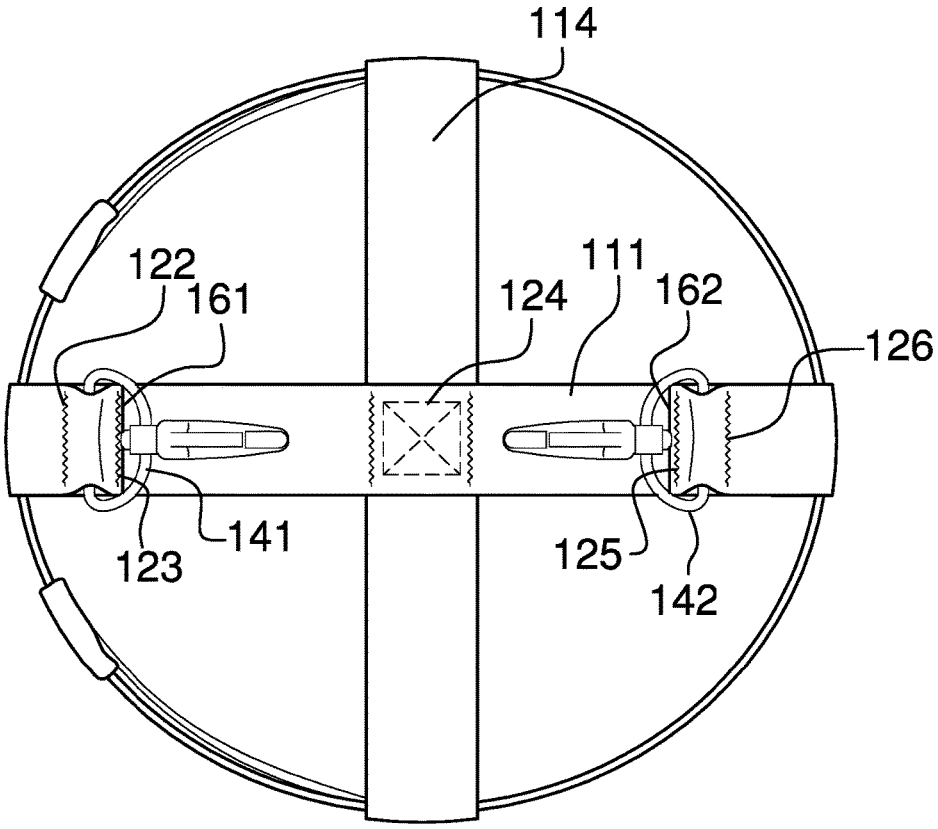
FIG. 5 is a top view of an embodiment of the disclosure.

Detailed reference will now be made to one or more potential embodiments of the disclosure, which are illustrated in FIGS. 1 through 5.

The neck and shoulder exercise device 100 (hereinafter invention) is a harness. The invention 100 is adapted for use with a person 181. The person 181 is further defined with a head 182. The invention 100 is worn on the head 182 of the person 181. The invention 100 attaches to a commercially available weight machine 183 commonly used for strength. By attaching the weights associated with the weight machine 183 to the invention 100 the person 181 can use the weight machine 183 to train the muscles supporting the head 182 of the person 181. The weight machine 183 is a commercially available strength training machine commonly found in health clubs. A cable loop 184 refers to a cable formed with a loop in the end. The cable loop 184 is commonly used component to attach grips and handles to the weight machine 183. The invention 100 comprises a plurality of straps 101, a plurality of seams 102, a plurality of hooks 103, and a fastener 104. The plurality of seams 102: 1) interconnects the plurality of straps 101 to each other; and, 2) attaches the plurality of hooks 103 to the plurality of straps 101. The fastener 104 secures the invention 100 to the head 182 of the person 181. The plurality of hooks 103 are used to attach the invention 100 to the weight machine 183.

Each of the plurality of straps 101 is a readily and commercially available webbing. The plurality of straps 101 comprises a first strap 111, a second strap 112, a third strap 113, a fourth strap 114, and a fourth strap 114, and a sixth strap 116. The first strap 111 is further defined with a first end 161 and a second end 162. The second strap 112 is further defined with a third end 163 and a fourth end 164. The third strap 113 is further defined with a fifth end 165 and a sixth end 166. The fourth strap 114 is further defined with a seventh end 167 and an eighth end 168. The fifth strap 115 is further defined with a ninth end 169 and a tenth end 170. The sixth strap 116 is further defined with an eleventh end 171 and a twelfth end 172.

Each of the plurality of seams 102 is a seam that makes an attachment selected from the group consisting of: 1) a first strap selected from the plurality of straps 101 to a second strap selected from the plurality of straps 101; 2) the first webbing 151 to a strap selected from the plurality of straps 101; and, 3) the second webbing 152 to a strap selected from the plurality of straps 101. In the first potential embodiment of the disclosure, each of the plurality of seams 102 is a sewn seam. The plurality of seams 102 comprises a first seam 121, a second seam 122, a third seam 123, a fourth seam 124, a fifth seam 125, and a sixth seam 126, a seventh seam 127, an eighth seam 128, a ninth seam 129, a tenth seam 130, an eleventh seam 131, a twelfth seam 132, a thirteenth seam 133, and a fourteenth seam 134.

Each of the plurality of hooks 103 is an attachment device that attaches the invention 100 to the weight machine 183. Each of the plurality of hooks 103 is identical. The plurality of hooks 103 comprises a first hook and D ring 141 and a second hook and D ring 142.

The first hook and D ring 141 is a commercially available combination of findings. The D ring attaches first hook and D ring 141 to the first strap 111 and the hook attaches the D ring to the cable loop 184. The second hook and D ring 142 is a commercially available combination of findings. The D ring attaches second hook and D ring 142 to the first strap 111 and the hook attaches the D ring to the cable loop 184.

In the first potential embodiment of the disclosure, the hook of the first hook and D ring 141 is a carabiner. In the first potential embodiment of the disclosure, the hook of the second hook and D ring 142 is a readily and commercially available webbing.

The fastener 104 is a commercially available fastening device that is used to secure the invention 100 to the head 182 of the person 181. The fastener 104 is adjustable to allow the invention 100 to be fitted to the person 181. In the first potential embodiment of the disclosure, the fastener 104 is a quick release buckle. The fastener 104 comprises a first webbing 151, a second webbing 152, a male connector 153, a female connector 154, and a ring and slider arrangement 155. The first webbing 151 is a readily and commercially available webbing. The second webbing 152 is a readily and commercially available webbing. The male connector 153 is the male connector of the quick release buckle that forms the fastener 104. The female connector 154 is the female connector of the quick release buckle that forms the fastener 104. The ring and slider assembly 155 is commercially available.

The assembly of the invention 100 is described in the following 6 paragraphs.

The first seam 121 attaches the first strap 111 to center of the second strap 112. The first strap 111 is folded around the second strap 112 before the first seam 121 joins the first strap 111 to the second strap 112. The second seam 122 attaches the first strap 111 on to first strap 111 after the first end 161 of the first strap 111 is folded. The third seam 123 attaches the first end 161 of the first strap 111 to the body of the first strap 111. The third seam 123 attaches the first hook and D ring 141 to the first strap 111. The fourth seam 124 attaches the face of the first strap 111 to the face of the fourth strap 114.

The sixth seam 126 attaches the first strap 111 on to first strap 111 after the second end 162 of the first strap 111 is folded. The fifth seam 125 attaches the second end 162 of the first strap 111 to the body of the first strap 111. The fifth seam 125 attaches the second hook and D ring 142 to the first strap 111. The seventh seam 127 attaches the third end 163 of the second strap 112 and the fourth end 164 of the second strap 112 to the first strap 111. The second strap 112 is sandwiched between the faces of the first strap 111. The eighth seam 128 attaches the center of the third strap 113 to the first strap 111. The first strap 111 is folded around the third strap 113 before the eighth seam 128 joins the first strap 111 to the third strap 113.

The ninth seam 129 attaches the seventh end 167 of the fourth strap 114 to the face of the third strap 113. The tenth seam 130 attaches the eighth end 168 of the fourth strap 114 to the face of the third strap 113.

The eleventh seam 131 attaches the tenth end 170 of the fifth strap 115 to the second strap 112. The tenth end 170 of the fifth strap 115 is folded around the second strap 112 before being joined together by the eleventh seam 131. The twelfth seam 132 attaches together: 1) the fifth end 165 of the third strap 113; 2) the ninth end 169 of the fifth strap 115; and, 3) the thirteenth end 173 of the first webbing 151.

The thirteenth seam 133 attaches the twelfth end 172 of the sixth strap 116 to the second strap 112. The twelfth end 172 of the sixth strap 116 is folded around the second strap 112 before being joined together by the thirteenth seam 133. The fourteenth seam 134 attaches together: 1) the sixth end 166 of the third strap 113; 2) the eleventh end 171 of the sixth strap 116; and, 3) the fifteenth end 175 of the second webbing 152.

The male connector 153 attaches to the fourteenth end 174 of the first webbing 151. The female connector 154 and the ring and slider arrangement 155 attaches to the sixteenth end 176 of the second webbing 152. Methods to attach connectors and ring and sliders are well known in the textile and apparel arts.

The following definitions were used in this disclosure:

Band: As used in this disclosure, a band is a flat loop of material.

Buckle: As used in this disclosure, a buckle is a fastening that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Carabiner: As used in this disclosure, a carabiner is coupling link that is usually formed as an oblong metal ring with one spring hinged side that is used to open and close the ring. Synonyms for carabiner include D-link.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

Findings: As used in this disclosure, findings are small decorative elements, fasteners, or tools for fit, function, or adjustment that are used with apparel or footwear.

Harness: As used in this disclosure, a harness is an apparatus comprising a plurality of straps and one or more fasteners that is used to fasten or anchor a first person or first object to a second object.

Hook: As used in this disclosure, a hook is an object that is curved or bent at an angle such that items can be hung on or caught by the object.

Loop: As used in this disclosure, a loop is the length of a first linear structure including, but not limited to, shafts, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Ring and Slider Arrangement: As used in this disclosure, a ring and slider arrangement is an apparatus comprising a ring component and a slider component that is used to adjust the effective length of a webbing in an application. In the ring and slider arrangement, an end of the webbing is inserted through the slider component, looped through the ring component and then reverse threaded through the slider component for a second time. By adjusting the position of the slider component relative to the webbing, the effective length of the webbing can be adjusted. Ring and slider arrangements are well known and documented in the textile arts.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A harness comprising: a plurality of straps, a plurality of seams, a plurality of hooks, and a fastener; wherein the plurality of seams interconnect the plurality of straps to each other; wherein the fastener secures the harness to a head of a user wherein the plurality of hooks attach the harness to a weight machine; wherein the harness is worn on the head of the user; wherein by attaching weights associated with the weight machine to the harness the user is capable of using the weight machine to train muscles supporting the head of the user; wherein the weight machine comprises a cable loop; wherein the cable loop is a cable formed with a loop at an end of the cable; wherein the plurality of straps comprises a first strap, a second strap, a third strap, a fourth strap, a fifth strap, and a sixth strap; wherein the first strap, the second strap, the third strap, the fourth strap, the fifth strap, and the sixth strap are interconnected; wherein the first strap comprises a first end, a second end, a body and a face; wherein the second strap comprises a first end, a second end, a body and a face; wherein the third comprises a first end, a second end, a body and a face; wherein the fourth strap comprises a first end, a second end, a body and a face; wherein the fifth strap comprises a first end, a second end, a body and a face; wherein the sixth strap comprises a first end, a second end, a body and a face; wherein the plurality of seams comprises a first seam, a second seam, a third seam, a fourth seam, a fifth seam, and a sixth seam, a seventh seam, an eighth seam, a ninth seam, a tenth seam, an eleventh seam, a twelfth seam, a thirteenth seam, and a fourteenth seam; wherein each of the plurality of hooks is an attachment device attached to the harness; wherein the fastener comprises a first webbing, a second webbing, a male connector, a female connector, and a ring and slider arrangement; wherein the ring and slider arrangement adjusts a length of a webbing selected from the group consisting of the first webbing and the second webbing.

2. The harness according to claim 1, wherein the first strap is a webbing; wherein the second strap is a webbing; wherein the male connector is the male connector of a quick release buckle; wherein the female connector is the female connector of the quick release buckle.

3. The harness according to claim 2, wherein the first seam attaches the first strap to a center of the second strap; wherein the first strap is folded around the second strap before the first seam joins the first strap to the second strap.

4. The harness according to claim 3, wherein the second seam attaches the first strap to the first strap after the first end of the first strap is folded; wherein the third seam attaches the first end of the first strap to the body of the first strap; wherein the third seam attaches a first hook of the plurality of hooks and a first D ring to the first strap.

5. The harness according to claim 4, wherein the fourth seam attaches the face of the first strap to the face of the fourth strap; wherein the sixth seam attaches the first strap to the first strap after the second end of the first strap is folded; wherein the fifth seam attaches the second end of the first strap to the body of the first strap; wherein the fifth seam attaches a second hook of the plurality of hooks and a second D ring to the first strap.

6. The harness according to claim 5, wherein the seventh seam attaches the first end of the second strap and the second end of the second strap to the first strap; wherein the second strap is sandwiched between the faces of the first strap.

7. The harness according to claim 6, wherein the eighth seam attaches the center of the third strap to the first strap; wherein the first strap is folded around the third strap before the eighth seam joins the first strap to the third strap.

8. The harness according to claim 7, wherein the ninth seam attaches the first end of the fourth strap to the face of the third strap; wherein the tenth seam attaches the second end of the fourth strap to the face of the third strap; wherein the eleventh seam attaches the second end of the fifth strap to the second strap; wherein the second end of the fifth strap is folded around the second strap before being joined together by the eleventh seam.

9. The harness according to claim 8, wherein the twelfth seam attaches together: 1) the first end of the third strap; 2) the first end of the fifth strap; and, 3) a first end of the first webbing; wherein the thirteenth seam attaches the second end of the sixth strap to the second strap; wherein the second end of the sixth strap is folded around the second strap before being joined together by the thirteenth seam.

10. The harness according to claim 9, wherein the fourteenth seam attaches together: 1) the second end of the third strap; 2) the first end of the sixth strap; and, 3) a first end of the second webbing; wherein the male connector attaches to a second end of the second webbing.

11. The harness according to claim 10, wherein the first D ring attaches to the first strap and the first hook attaches the harness to the cable loop.

12. The harness according to claim 11, wherein the second D ring attaches to the second strap; wherein the second hook attaches the harness to the cable loop.

* * * * *